US011389691B2

(12) United States Patent
Reed, III

(10) Patent No.: US 11,389,691 B2
(45) Date of Patent: Jul. 19, 2022

(54) EXERCISE PLATFORM

(71) Applicant: Floyd E. Reed, III, Rogers, AR (US)

(72) Inventor: Floyd E. Reed, III, Rogers, AR (US)

( * ) Notice: Subject to any disclaimer, the term of this patent is extended or adjusted under 35 U.S.C. 154(b) by 0 days.

(21) Appl. No.: 16/752,184

(22) Filed: Jan. 24, 2020

(65) Prior Publication Data

US 2021/0228936 A1 Jul. 29, 2021

(51) Int. Cl.

*A63B 21/00* (2006.01)
*A63B 21/04* (2006.01)
*A63B 1/00* (2006.01)

(52) U.S. Cl.

CPC ..... *A63B 21/4033* (2015.10); *A63B 1/00* (2013.01); *A63B 21/00185* (2013.01); *A63B 21/04* (2013.01); *A63B 2208/0204* (2013.01); *A63B 2225/093* (2013.01)

(58) Field of Classification Search

CPC ..... A63B 21/00047; A63B 21/0005; A63B 21/00054; A63B 21/00185; A63B 21/04; A63B 21/0407; A63B 21/0421; A63B 21/0442; A63B 21/0552; A63B 21/16; A63B 21/4023; A63B 21/4033; A63B 21/4037; A63B 6/00; A63B 6/02

See application file for complete search history.

(56) References Cited

U.S. PATENT DOCUMENTS 5,076,571 A * 12/1991 Croce, Jr. ..... A63B 69/0022 472/90
10,512,814 B1 * 12/2019 Conroy ..... A63B 22/20
10,744,363 B1 * 8/2020 Jaquish ..... A61H 23/0263
2003/0104910 A1 * 6/2003 McCoy ..... A47G 27/0418 482/142
2005/0101444 A1 * 5/2005 Dadbeh ..... A63B 23/10 482/52
2006/0128540 A1 * 6/2006 Engle ..... A63B 21/04 482/123
2012/0115692 A1 * 5/2012 Bussen ..... A63B 21/0442 482/130
2014/0031183 A1 * 1/2014 Blake ..... A63B 23/03541 482/130
2014/0087927 A1 * 3/2014 Richard ..... A63B 23/03541 482/123
2020/0324163 A1 * 10/2020 Berry ..... A63B 22/0046

* cited by examiner

*Primary Examiner* — Nyca T Nguyen
*Assistant Examiner* — Zachary T Moore
(74) *Attorney, Agent, or Firm* — Buckingham Doolittle Burroughs; Tim Hodgkiss

(57) ABSTRACT

An exercise platform for use with a resilient exercise band includes a body formed of ultra-high molecular weight polyethylene. The exercise platform includes a pair of intersecting channels one side and a support surface on another side upon which a user stands. When the platform is in use, the channels are spaced away from a floor surface, and are dimensioned to allow a portion of the exercise band to be retained therein, as the user performs an exercise movement employing the exercise band while he or she stands on the platform.

19 Claims, 5 Drawing Sheets

EXERCISE PLATFORM

TECHNICAL FIELD

The various embodiments disclosed herein relate to exercise equipment. In particular, the various embodiments disclosed herein relate to exercise platforms. More particularly, the various embodiments disclosed herein relate to exercise platforms for use with exercise bands.

BACKGROUND

As people increasingly take an interest in their health, they continue to seek out various exercise and training routines. One type of exercise or training routine involves the use of one or more elastic bands to supply a source of resistance as an individual performs an exercise movement. That is, during the exercise movement, the elastic bands are stretched, thereby imparting resistive tension to the body part that is being exercised. In some cases, the elastic bands may apply a significant amount of tension. During these exercises, some portion of the elastic band is required to be anchored, or fixed in position, so that the resistive force of the elastic band may be realized.

For example, in the case of arm curls, an elongated bar that is connected to the elastic band may be utilized. However, the elastic band must be secured or fixed at some point, while the portions of the elastic band that are attached to the elongated bar is able to be stretched away from this fixed point to allow the resistive force or tension to be transferred to the elongated bar and to the user's arms during the arm curl exercise.

When the elastic band comprises a closed loop, a user places their feet on a mid-section of the loop, so as to use their weight retain the elastic band in place. As a result, the two free, terminal ends of the loop are attached to the curl bar. Thus, as the curl bar is moved upward and downward to perform the "arm curl" exercise, tension is formed in each of the two terminal ends of the loop that are attached to the bar, so as to create resistance on the user's arms.

The amount of force that is developed in the elastic band is significant, given that it must be to be a physical challenge to the user of the curl bar in order to have a physiological impact in the user's muscles. Accordingly, this significant tension generated in the elastic band is imparted into the feet of the user who is standing on the band, which may result trauma or injury to relatively soft tissue (muscle, tendon, ligaments) of the user's feet, or at the very least makes the user's feet uncomfortable over the course of time in which the arm curl exercise is performed. Thus, this comfortability may lead to a premature cessation of their workout routine, which is unwanted.

Therefore, it would be desirable to have a suitable exercise platform for a user to stand on who desires to perform elastic band exercises that requires some portion of an elastic band to be fixed in position, so as to avoid potential trauma, injury or uncomfortableness of performing exercises using exercise bands. It would also be desirable to have a suitable exercise platform that reduces the coefficient of friction between the exercise band and the platform itself, so as to extend the life of the exercise band, while preventing injury to the user.

SUMMARY

It is one aspect to provide an exercise platform that includes a body having a first surface opposite a second surface; a first channel disposed in the second surface; and a second channel disposed in the second surface that intersects the first channel.

It is another aspect to provide an exercise kit including one or more exercise platforms having a body having a first surface opposite a second surface; a first channel disposed in the second surface; and a second channel disposed in the second surface that intersects the first channel; and one or more exercise bands.

BRIEF DESCRIPTION OF THE DRAWINGS

These and other features and advantages of the various embodiments disclosed herein will become better understood with regard to the following description, appended claims, and accompanying drawings, wherein:

DETAILED DESCRIPTION

Figure 1:
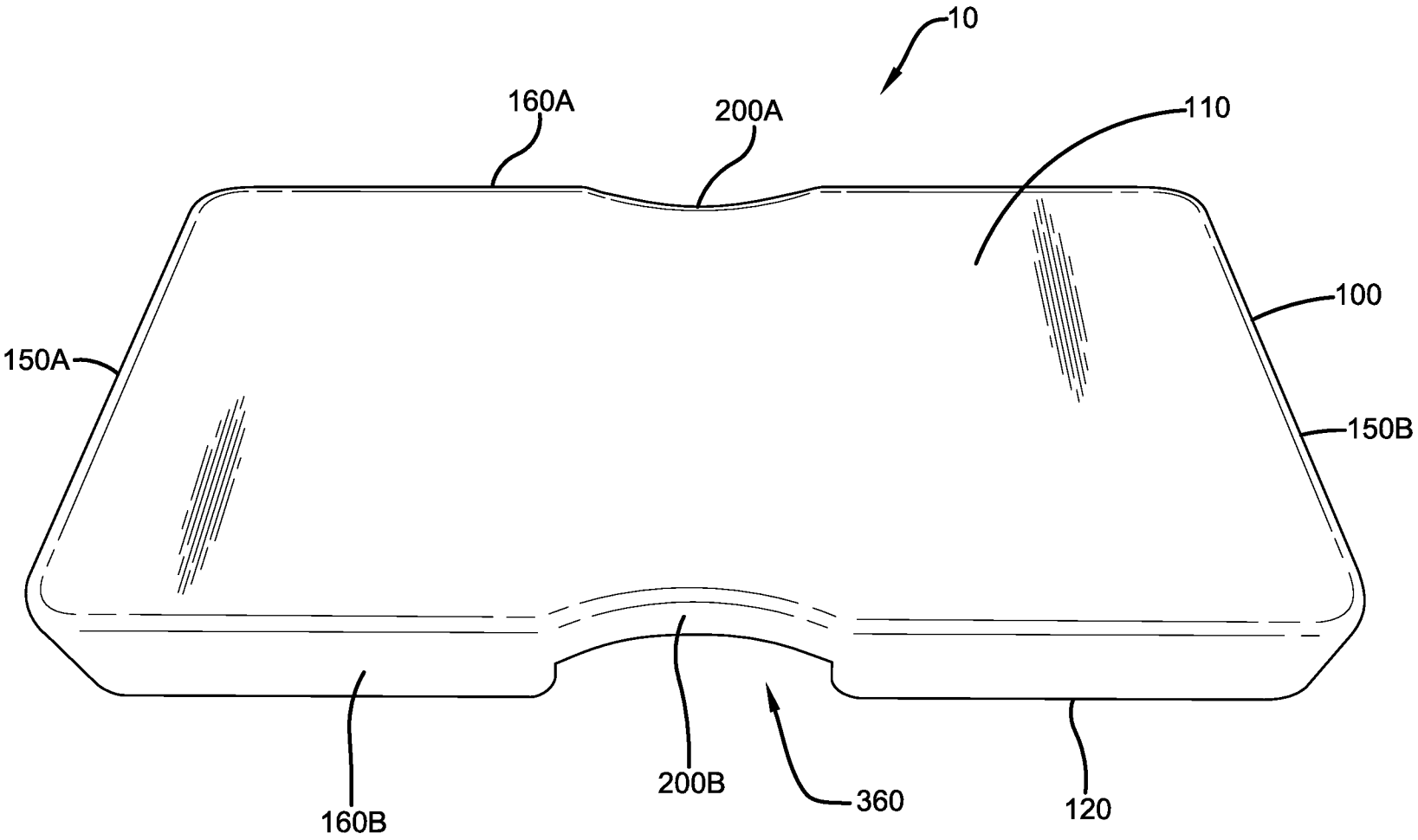
FIG. 1 is a perspective view of an exercise platform in accordance with the concepts of the various embodiments disclosed herein.

Various embodiments of an exercise platform 10 that is configured for use with an exercise band 20 are set forth in the FIGS. The exercise platform 10 includes a pair of channels or grooves 30 and 40 that intersect each other. The channels 30 and 40 are configured to receive therein a portion of the exercise band 20. Given the recessed configuration of the channels 30 and 40, they serve to capture therein the width dimension of the exercise band 20.

Specifically, the exercise platform 10 comprises a body 100 having a surface 110 for a user to stand on or to place their body weight or some portion thereof on, and a surface 120 configured to be positioned proximate to a floor or other support surface. In some embodiments, the surfaces 110 and 120 may be opposed. The body 100 may have any suitable cross-sectional thickness or shape. In some embodiments, the body 100 may be substantially rectilinear, but is not required, as the body 100 may be rectilinear, curvilinear or a combination thereof.

In some embodiments the body 100 may be bounded by opposed edges 150A and 150B and edges 160A and 160B. It should be appreciated that the edges 160A and 160B may each include respective recesses 200A and 200B. In some cases, the recesses 200A-B may be curved, so as to be concave or convex.

Figure 2:
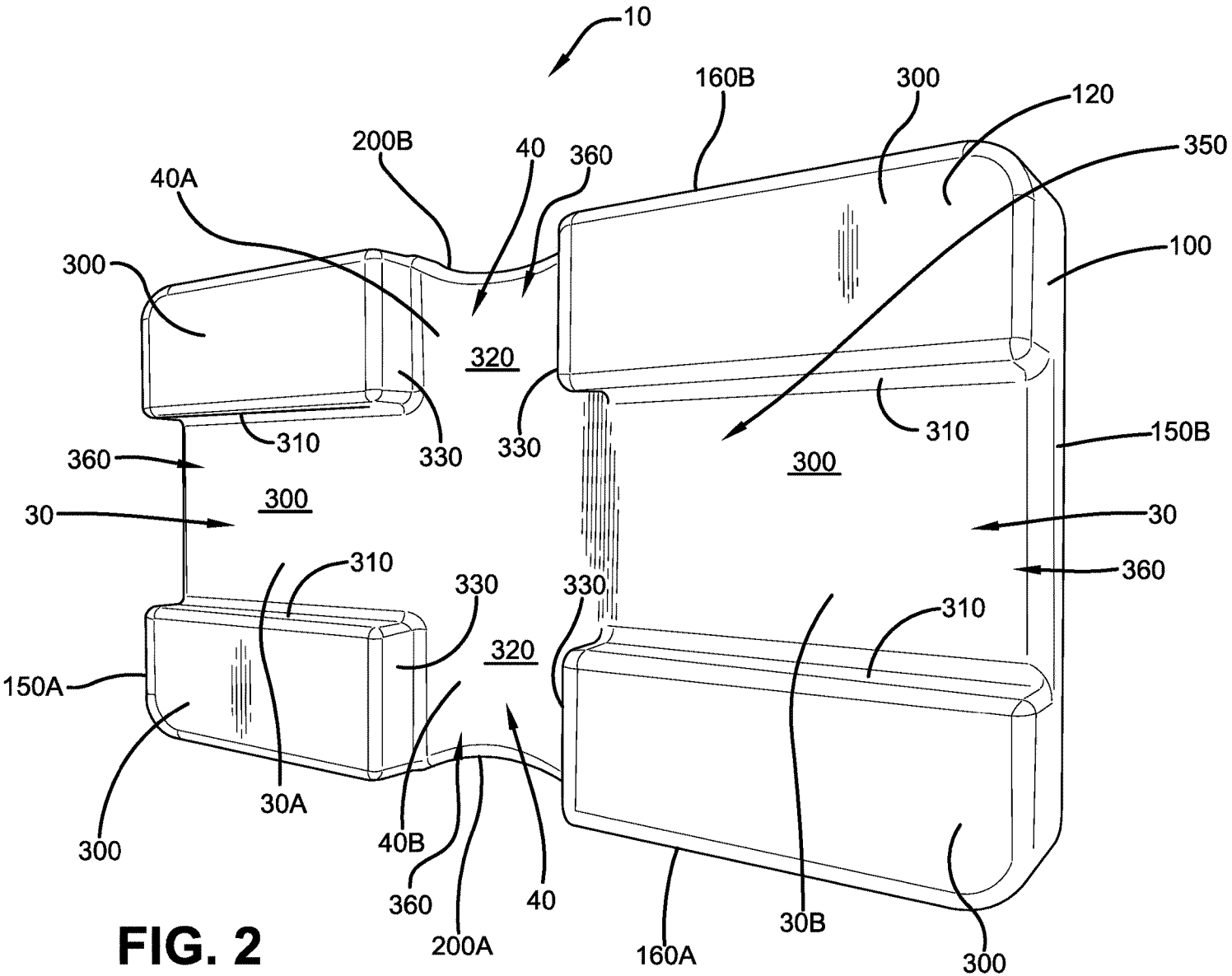
FIG. 2 is a perspective view of one side of the exercise platform in accordance with the concepts of the various embodiments disclosed herein.

Disposed on surface 120 of the body are the channels 30 and 40, as shown in FIG. 2, whereby the channel 30 extends along the longitudinal axis of the body 100, and the channel 40 extends at a substantially right angle to the longitudinal axis of the body 100. However, it should be appreciated that the channels 30 and 40 may be arranged at other angles other than right angles. As previously discussed, channels 30 and 40 intersect each other so as to divide each of the channels 30 and 40 into sections. As such, channel 30 is defined by a channel section 30A and a channel section 30B, while channel 40 is defined by a channel section 40A and a channel section 40B. In addition, the intersecting channels 30 and 40 form a plurality of legs 300 that are configured to be placed onto a support surface, such as a floor. Thus, in some embodiments, the channels 30 and 40 may be the same length or may be different lengths, where one channel is longer than the other. It should also be appreciated that in some embodiments, the channel 30 is centered between the edges 160A and 160B of the exercise platform 10. In addition, in some embodiments, the channel 40 is centered between the edges 150A and 150B of the platform 10. However, one or more of the channels 30 and 40 may be arranged so that they are not centered relative to the respective edges 160A-B and 150A-B of the platform 10. As shown in FIG. 2, both channels 30 and 40 may be arranged so that they are centered relative to the respective edges 160A-B and 150A-B of the platform 10.

The channel sections 30A-B include a channel cap surface 300 that is bounded laterally by opposed walls 310 formed by the legs 300. In addition, the channel sections 40A-B include a channel cap surface 320 that is bounded laterally by opposed walls 330 formed by legs 300. Thus, the channels 30 and 40 form a recessed cross configuration 350 within the surface 120. Accordingly, when the legs 300 are placed on the floor or other support surface the recessed cross configuration 350 is separated or spaced from the floor by a gap, and the ends of each channel 30 and 40 that are proximate to the edges 150A-B and 160A-B are open (i.e. openings 360 between the legs 300 formed on each edge 150A-B and 160A-B; it should be appreciated that these openings may include a curved or radiused edge to reduce the friction generated with the exercise band 20 that is in contact therewith). The channels 30 and 40 have a width and depth dimension that is able to accommodate the width and depth dimension of the elastic band 20. Meaning that the channels 30 and 40 are capable of receiving the elastic band 20 therein. The channels 30 and 40 are configured to have a width dimension that is greater than or equal to the width dimension of the exercise band.

Figure 3:
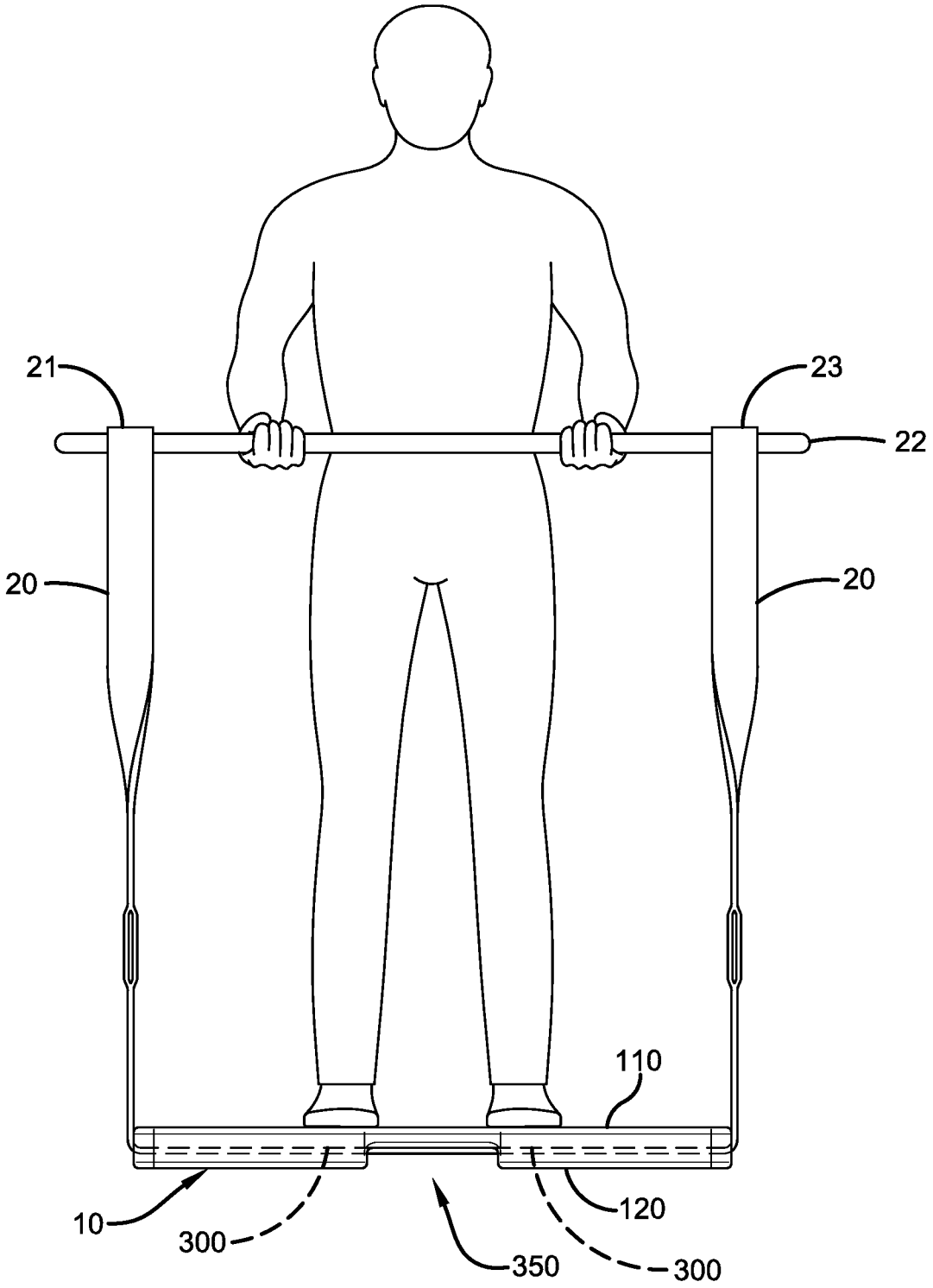
FIG. 3 is a perspective view showing a user standing on the exercise platform holding an exercise bar that is attached to an exercise band in accordance with the concepts of the various embodiments disclosed herein.

Accordingly, when the body 100 is placed so that the legs 300 are placed in contact with a support surface, such as a floor, a gap is created between the floor and the channel cap surface 300, the channel cap surface 320, and the floor. Through these gaps, the body of the exercise band 20 is received depending on whether channels 30 or 40 are being used, as shown in FIG. 3. The ends 21 and 22 of the exercise band 20 are then attached to an pieces of exercise equipment to which the exercise band 20 applies resistance. For example, the ends 21 and 22 of the exercise band 20 may be attached to an exercise bar 23, such as that used for arm curls by a user. In some embodiments, the exercise bar 23 may be received through loops formed by the closed exercise band 20 at its ends 21 and 22.

It should be appreciated that in other embodiments, the body 100 of the exercise platform 10 may include one or more apertures disposed therethrough and/or other structures to facilitate the use of the elastic bands for exercising. Such structures and apertures may be provided to enable one or more elastic bands to be attached thereto, or to allow other peripheral structures or items to be attached to the body 100 of the exercise platform 10 to enable other exercises to be performed by the user of the platform 10.

It should be appreciated that the body 100 may be formed of any suitable material, including but not limited to plastic, wood, metal, or other material, such as polymeric material. In some embodiments, the body 100 may be formed from polyethylene, including ultra-high molecular weight (UHMW) polyethylene. It should be appreciated that the use of UHMW polyethylene provides a low coefficient of friction relative to the exercise band 20 that in in contact therewith. This low friction coefficient, also reduces the noise that is generated between the exercise band 20 and the platform 10 when the exercise band 20 is stretched. Thus, as the exercise band 20 moves or slides over the surfaces of the body 100, including the corners of the openings 360 of the channel 30, 40 gaps, the wear on the exercise band 20 is reduced. That is, the potential for fraying or wear of the exercise band 20 is reduced, while the operating life of the exercise band 20 is extended. This also reduces the risk of the exercise band failing and snapping, which could result in a significant injury to the user of the platform 10.

In some embodiments, the surface 110 may be configured with recesses to receive at least a portion of the dimension and shape of the legs 300 of a second exercise platform 10 so that multiple exercise platforms 10 may be stacked one on top of another.

It should be appreciated that one or more exercise platforms 10, the exercise band 20, and various other accessories, including the retention device, may be provided as a kit in any combination. Alternatively, the exercise platform 10, the exercise band 20 and the retention device may be provided separately in any combination.

Alternatively, the exercise platform 10 may include a retaining device 111, such as a clip on one or more of its edges 150 and 160 to allow multiple platforms 10 to be attached thereto. Accordingly, the channels 30 and 40 may be extended in length as multiple platforms are used together. As such, the surface area of the surface 110 of the platform 10 may be increased, thereby allowing for various exercises to be performed, as well as allowing the user to have a wider stance for their feet. As previously discussed, multiple platforms 10 may be stacked, thus increasing the vertical distance the user is from the floor and reducing the slack in the exercise band 20 and increasing its resistance. In some embodiments, a platform 20 may be used for each foot of a user.

Additionally, the exercise band 20 may comprise any suitable elastic band, such as that formed as a closed loop (having no ends) or as a single segment having terminal ends, which is resilient and capable of imparting a resistive force to the user when the exercise band is stretched. In some cases, the exercise band 20 may be configured to have a flat profile, or flat opposed surfaces, however the exercise band 20 may take on any suitable shape, including a curvilinear shape, a rectilinear shape and combinations thereof.

In yet another embodiment, the platform 10 may be configured to include one or more additional channels 400 that extend at a substantially right angle to the longitudinal channel 30. However, it should be appreciated that the channels 400 and channel 30 may be arranged at other angles than right angles. These additional one or more channels 400 are arranged in some embodiments so that they are spaced apart from each other relative to edges 150A and 150B of the platform 10. In some embodiments, the one or more channels 400 may be utilized in addition to one or more of channel 30 and channel 40. For example, in some embodiments, the platform 10 may include the longitudinal channel 30 and one or more of the channels 400, whereby these channels 400 are positioned anywhere between the edges 150A and 1508 of the platform 10. In further embodiments, one or more of the channels 400 may be provided exclusive of both channel 30 and channel 40.

Figure 4:
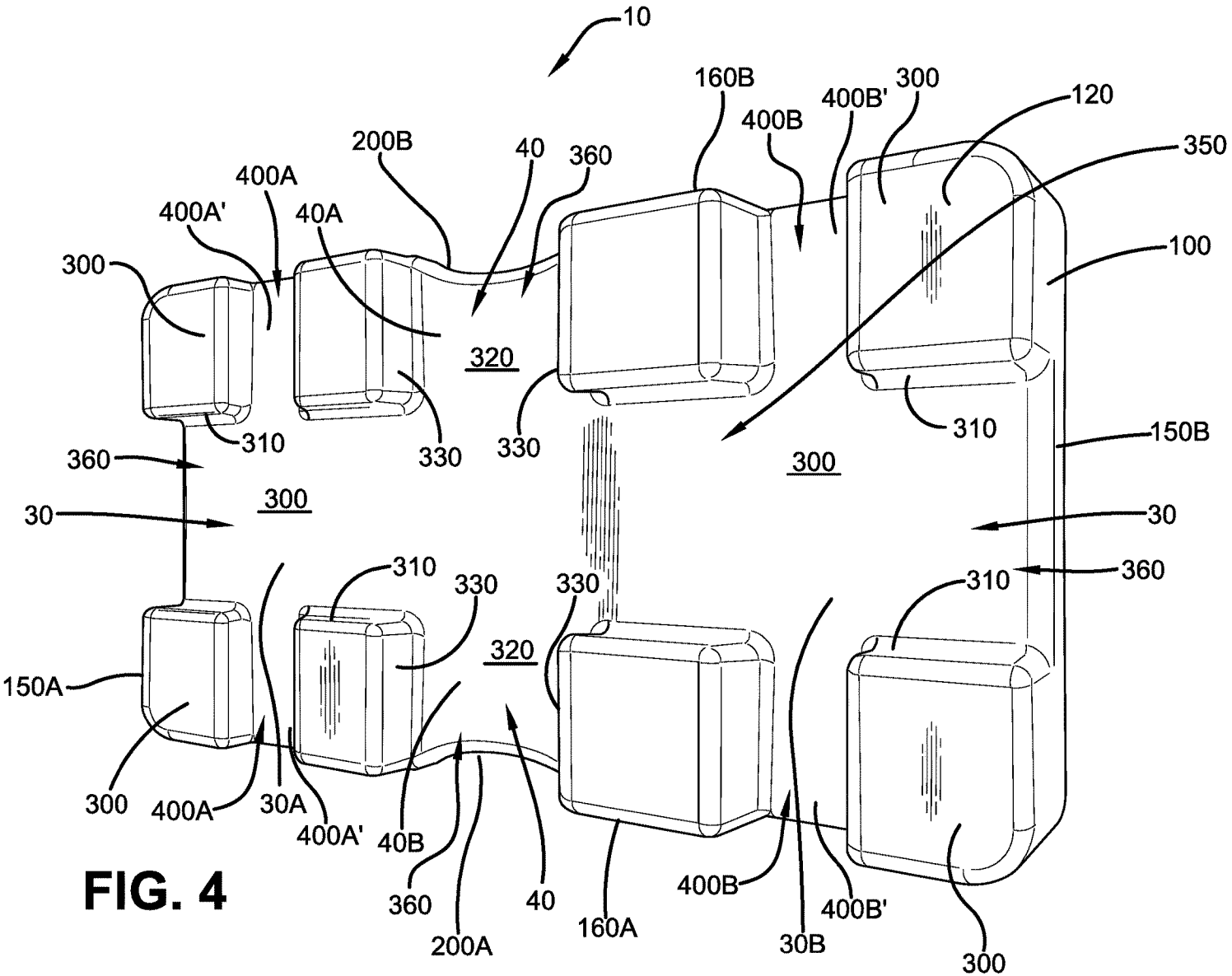
FIG. 4 is a perspective view of an alternative embodiment of the exercise platform in accordance with the concepts of the various embodiments disclosed herein.
Figure 5:
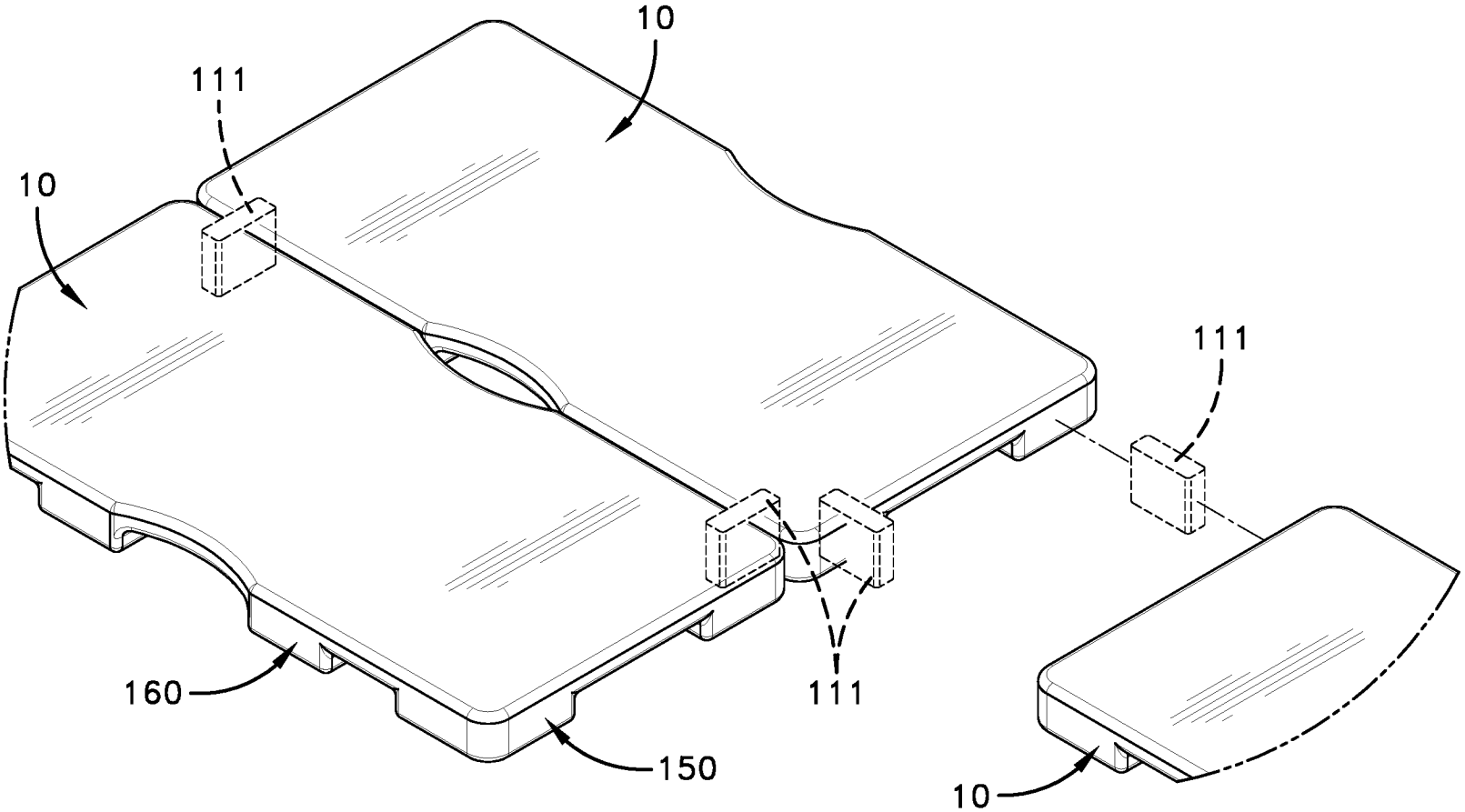
FIG. 5 is a perspective view of an alternative embodiment of the exercise platform including a retaining device to attach multiple exercise platforms together in accordance with the concepts of the various embodiments disclosed therein.

For example, in the case of the embodiment shown in FIG. 4, 2 channels, designated as 400A and 400B, are disposed on either side of the channel 40. Thus, the channels 400A and 400B form respective channel segment pairs 400A' and 400A" and channel segment pairs 400B' and 400B" that are positioned on either side of the longitudinal channel 30. As such, these channels 400A and 400B are configured, to receive respective exercise bands 20 therein. In some embodiments, the exercise band(s) 20 may be used with suitable handgrips or other exercise devices. For example, when a user of the platform 10 is standing thereon, the user may utilize the bands that are positioned within each of the channels 400A and 400B independently or together as they desire.

Therefore, it can be seen that the objects of the various embodiments disclosed herein have been satisfied by the structure and its method for use presented above. While in accordance with the Patent Statutes, only the best mode and preferred embodiments have been presented and described in detail, with it being understood that the embodiments disclosed herein are not limited thereto or thereby. Accordingly, for an appreciation of the true scope and breadth of the embodiments, reference should be made to the following claims.

What is claimed is:

1. An exercise platform for use with a flat exercise band having a flat surface, the exercise platform comprising:

a body having a first surface opposite a second surface, said second surface adapted to be positioned directly upon a support surface;

a first channel disposed in said second surface; and a second channel disposed in said second surface that intersects said first channel, wherein each end of said first and second channels extend into openings positioned at an edge of said body, said openings being defined by said body and the support surface, wherein a first group of said openings have a recessed edge, and wherein said first and second channels each have a pair of spaced walls that extend from a flat cap surface at a substantially right angle, and wherein a second group of said openings in said second channel are configured such that said flat cap surface terminates at said second group of said openings at a straight edge, such that at least a portion of the flat surface of the exercise band is positioned adjacent to said flat cap surface and adjacent to said straight edge when the exercise band is positioned in said first channel, and at least the portion of the flat surface of the exercise band is positioned adjacent to said flat cap surface and adjacent to said recessed edge when the exercise band is positioned in said second channel, and wherein said recessed edge and said straight edge are beveled.

2. The exercise platform of claim 1, wherein said body is formed of ultra-high molecular weight (UHMW) polyethylene.

3. The exercise platform of claim 1, wherein said openings defined by said body have a radiused edge that extends out of said opening.

4. The exercise platform of claim 1, wherein said first channel is longer than said second channel.

5. The exercise platform of claim 4, wherein said second channel comprises a plurality of said second channels, wherein a first one of said second channels is centered in said second surface, and a second and a third one of said second channels are positioned on either side of said first one of said second channels.

6. The exercise platform of claim 1, wherein the exercise platform is stackable with another exercise platform.

7. The exercise platform of claim 1, further comprising a retaining device configured to attach the exercise platform to another exercise platform.

8. The exercise platform of claim 1, wherein said first and second channels define a plurality of legs configured to be placed upon the support surface.

9. The exercise platform of claim 8, wherein when said legs are disposed on the support surface, said first and second channels are spaced away from the support surface by a gap.

10. The exercise platform of claim 1, wherein said first and second channels are defined by a plurality of legs extending from said second surface at a beveled interface.

11. An exercise kit comprising:

one or more exercise bands having a flat surface;

one or more exercise platforms for use with one or more of the exercise bands, the exercise band platform comprising:

a body having a first surface opposite a second surface, said second surface adapted to be positioned directly upon a support surface;

a first channel disposed in said second surface; and a second channel disposed in said second surface that intersects said first channel;

wherein each end of said first and second channels extend into openings positioned at an edge of said body, said openings being defined by said body and the support surface, wherein a first group of said openings in said first channel have a recessed edge, and wherein said first and second channels each have a pair of spaced walls that extend from a flat cap surface at a substantially right angle, and wherein a second group of said openings in said second channel are configured such that said flat cap surface terminates at said second group of said openings at a straight edge, such that at least a portion of the flat surface of the exercise band is positioned adjacent to said flat cap surface and adjacent to said straight edge when the exercise band is positioned in said first channel, and at least the portion of said flat surface of the exercise band is positioned adjacent to said flat cap surface and adjacent to said recessed edge when the exercise band is positioned in said second channel, and wherein said recessed edge and said straight edge are beveled.

12. The exercise kit of claim 11 further comprising:

a retaining device to attach at least two of said exercise platforms together.

13. The exercise kit of claim 11, wherein said body is formed of ultra-high molecular weight (UHMW) polyethylene.

14. The exercise platform of claim 11, wherein said openings defined by said body have a radiused edge that extends out of said opening.

15. The exercise kit of claim 11, wherein said first channel is longer than said second channel.

16. The exercise kit of claim 11, wherein the exercise platform is stackable with another exercise platform.

17. The exercise kit of claim 11, wherein said first and second channels define a plurality of legs configured to be placed upon the support surface.

18. The exercise kit of claim 17, wherein when said legs are disposed on the support surface, said first and second channels are spaced away from the support surface by a gap.

19. The exercise platform of claim 11, wherein said first and second channels are defined by a plurality of legs extending from said second surface at a beveled interface.

* * * * *